United States Patent [19]

Woodbury

[11] 4,113,157

[45] Sep. 12, 1978

[54] COMPARTMENTED RECEPTACLE

[76] Inventor: Dean F. Woodbury, 2202 W.N. Loop, Apt. 247, Austin, Tex. 78756

[21] Appl. No.: 664,585

[22] Filed: Mar. 8, 1976

[51] Int. Cl.[2] ..... A45C 1/04

[52] U.S. Cl. ..... 224/26 E; 24/163 K; 206/37; 224/5 L

[58] Field of Search ..... 224/5 R, 5 L, 26 R, 224/26 C, 26 D, 26 E, 29 R, 4 E, 28 B, 29 M; 206/0.8, 0.81, 0.83, 0.84, 37, 38; 24/3 R, 3 F, 163 K; 232/6, 1 D; 133/5 A, 6, 5 B, 8 E; 221/47, 48, 52, 56

[56] References Cited

U.S. PATENT DOCUMENTS

| | | | |
|---|---|---|---|
| 994,893 | 6/1931 | Voye | 206/0.84 X |
| 1,454,445 | 5/1923 | Lieberman | 133/6 |
| 1,503,241 | 7/1924 | Horwitt | 221/47 X |
| 1,558,406 | 10/1925 | Snyder | 24/3 F |
| 1,568,022 | 12/1925 | Landrum | 232/6 X |
| 1,578,468 | 3/1926 | Rankin | 224/26 E X |
| 1,818,033 | 8/1931 | Blair | 206/0.84 X |
| 2,443,477 | 6/1948 | Plepla | 224/4 E |
| 2,616,554 | 11/1952 | Wade et al. | 224/29 R X |
| 3,126,897 | 3/1964 | Sharpe | 133/6 |
| 3,148,426 | 9/1964 | Lesser et al. | 224/26 E X |
| 3,927,442 | 12/1975 | Foster | 24/163 K |

FOREIGN PATENT DOCUMENTS

| | | | |
|---|---|---|---|
| 2,222,972 | 10/1974 | France | 224/26 E |
| A28,749 of | 1910 | United Kingdom | 224/26 E |

*Primary Examiner*—Trygve M. Blix
*Assistant Examiner*—Winston H. Douglas
*Attorney, Agent, or Firm*—Gregory J. Nelson

[57] ABSTRACT

A compartmented receptacle for the organized storage of personal items such as coins, currency, keys, credit cards and the like is disclosed. A front section is hinged to a rear section. One section is provided with coin dispensing channels and compartments for other items. The opposite section defines a generally rectangular compartment adapted to receive credit cards or similar items. In the preferred embodiment, the receptacle can be attached to a belt and has the appearance of an ornamental belt buckle.

8 Claims, 11 Drawing Figures

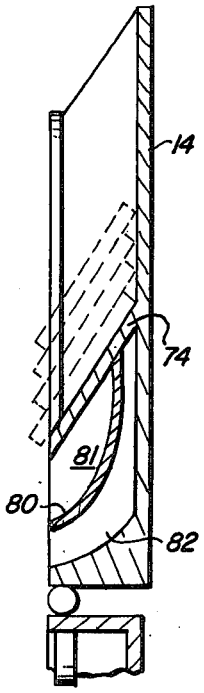
FIG. 5
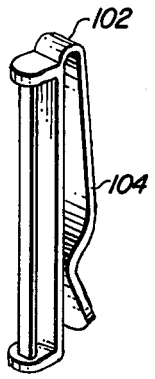
FIG. 6
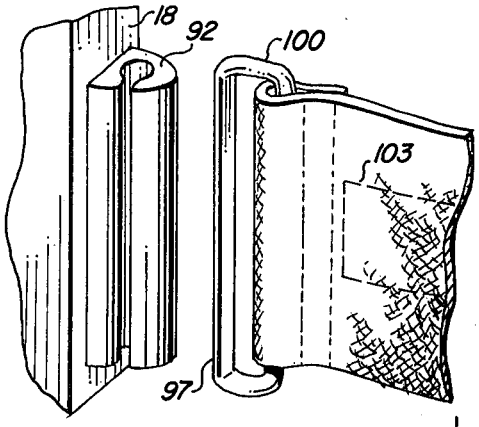
FIG. 7
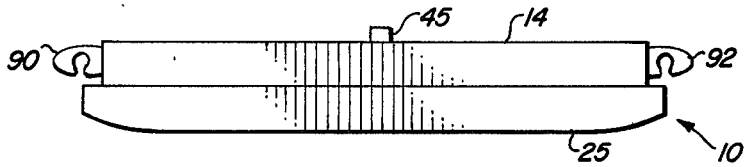
FIG. 8
FIG. 9
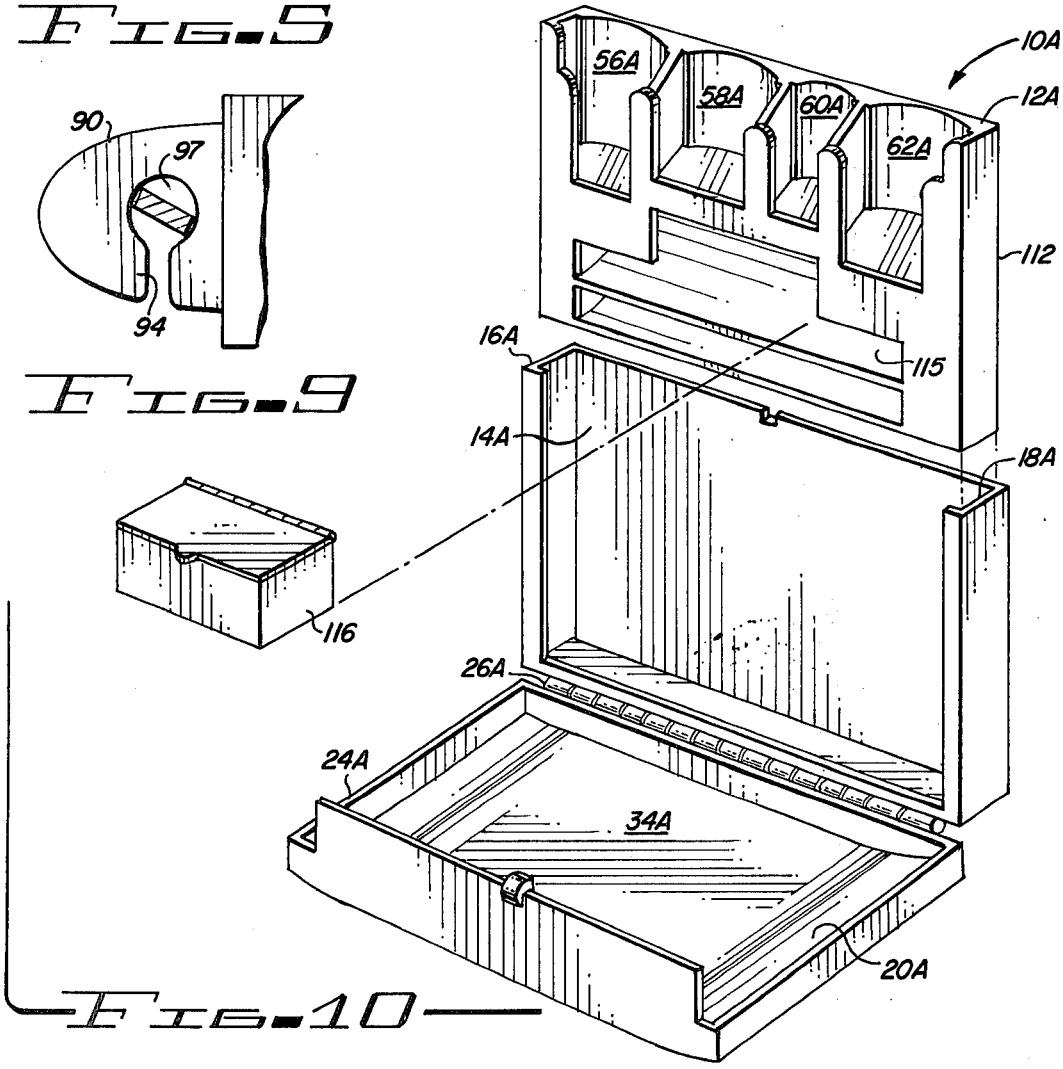
FIG. 10

COMPARTMENTED RECEPTACLE

The present invention relates to a compartmented receptacle for holding various items and more particularly relates to a compartmented belt buckle for containing coins, currency, keys and other similar items in an organized manner for convenient reception and so the items may be easily dispensed.

It is common for the individual to carry various items such as coins, currency, keys, credit cards, driver's license, medications and the like. These items are usually carried in a billfold or wallet. Carrying these items loosely in the pocket is not convenient and often results in uncomfortable, unsightly bulges in wearing apparel. Similarly, most billfolds or wallets are not designed to accommodate all of these items. Further, conventional wallets carried in a coat or trouser pocket may be an invitation to a thief or mugger.

Various compartmented devices are found in the prior art for storing items commonly carried by individuals necessary to their everyday activities. For example, it is known to construct a combination belt buckle and purse having a hinged cover which can be opened to receive various articles. However, the mere provision of an internal compartment within a belt buckle does not provide convenient storage for all the various items commonly carried by individuals. The provision of a single compartment within a belt buckle or purse requires that these various items be commonly housed making it difficult for the wearer to locate a particular item, as for example, a coin. Further, when the compartment is opened, the contents can easily be spilled to the annoyance and inconvenience of the user.

Other approaches to the problem are to incorporate a tongue or similar member in the compartment so that certain items can be selectively retained behind the tongue. While this construction represents an improvement over devices merely providing a compartment, holders of this type do not accommodate all of the various and sundry items commonly carried by individuals.

The present invention provides a unique organizer receptacle for accessories commonly carried by individuals. The receptacle may be in the form of an ornamental buckle or may be in the form of a separate compartmented receptacle attachable to a belt or other article of apparel. The receptacle of the present invention is compartmented or sub-divided to contain common items such as coins, currency, credit cards, keys and the like. The receptacle is small and compact and when attached to a belt or the like, it is unobtrusive and unobvious to a perspective thief or mugger. Further, the various compartments are designed so that the items contained in these compartments are conveniently and readily available to the user.

Briefly, in accordance with the present invention, the receptacle of the present invention includes a cover or lid section hinged to a rear section. Opposite side of the rear section are provided with an appropriate clip assembly for securement of the device to a belt or article of apparel. The rear section defines a series of coin receiving channels. The channels are configured so that the coins are disposed for easy removal when the buckle is opened. Appropriate compartments for keys and coins are also provided in the rear section of the receptacle. The cover section defines a generally rectangular compartment having retaining tabs for receiving credit cards or other similar items. In a closed position, the device is compact and may be provided with surface ornamentation and have the appearance of an ordinary belt buckle therefore reducing the possibility of theft and increasing the security of the device.

The above and other objects and advantages of the present invention will be appreciated and better understood by reference to the following description read in conjunction with the accompanying drawings in which:

FIG. 5 is a sectional view taken along lines 5—5 of FIG. 2;

FIG. 6 is a detail view illustrating a form of clip which may be used in connection with the receptacle of the present invention;

FIG. 7 is a partial detail view illustrating a link which may be used to secure the receptacle of the present invention to a belt;

FIG. 8 is a top view illustrating the receptacle in a closed position;

FIG. 9 is a partial detail view illustrating the flange at the side of the receptacle;

FIG. 10 is a perspective view of an alternate embodiment of the present invention.

Figure 1:
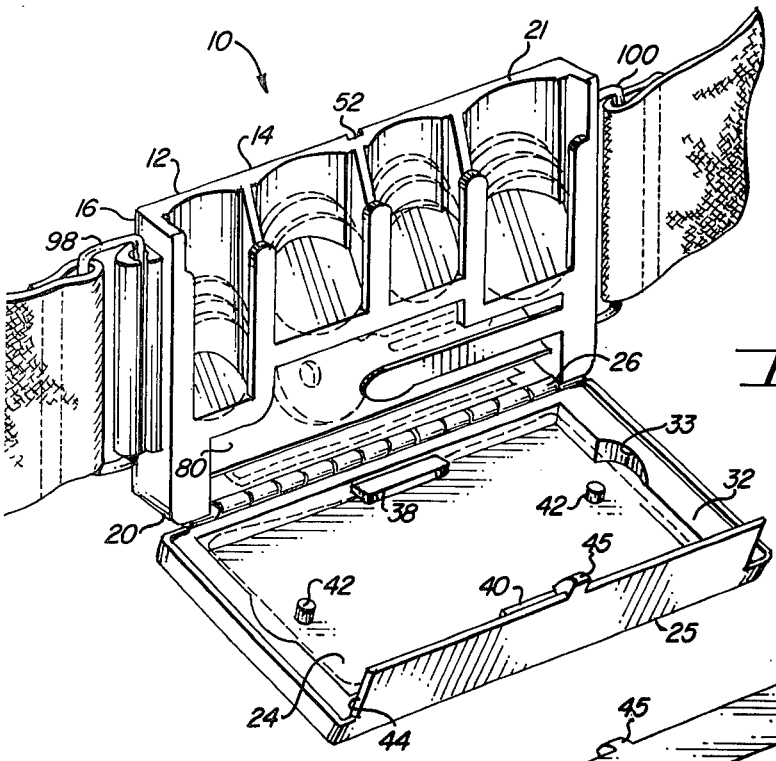
FIG. 1 is a perspective view illustrating the receptacle of the present invention in an open position attached to a belt and containing various items.
Figure 11:
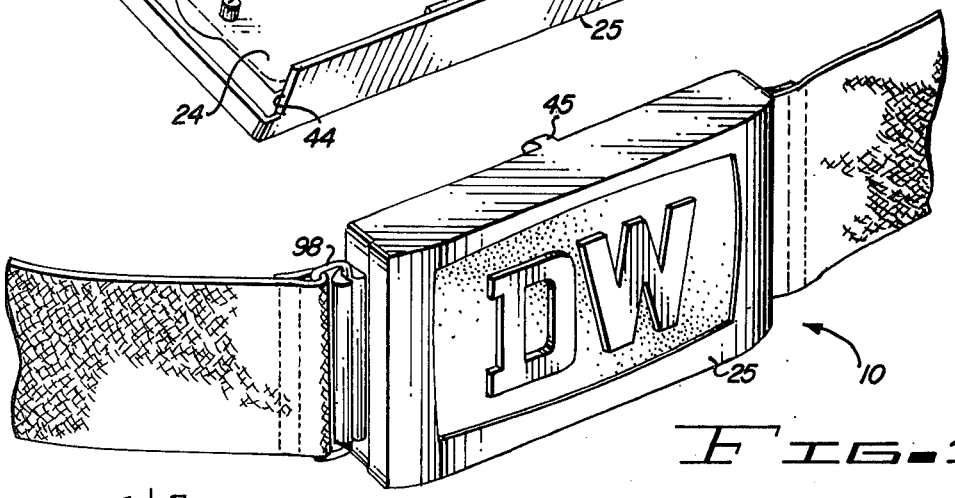
FIG. 11 is a perspective view of the receptacle of the present invention in a closed position.

Referring now to the various figures of the drawings, the receptacle of the present invention is generally designated by the numeral 10 and includes a rear or base section 12 having a back plate 14, opposite sidewalls 16 and 18 and top and bottom edges 20 and 21. A front or cover section 24 is secured to the rear section 12 at transversely extending hinge 26. As seen in FIG. 1 the front and rear sections may be pivoted relative to one another to an open position for reception or removal of articles.

The front section 24 is formed having a face plate 25. The inner surface of plate 25 has a rectangular peripheral edge 32 which defines a generally rectangular recessed compartment 34 which is preferably sized to accommodate credit cards. Semi-circular or eliptical cut-outs 33 are provided in the opposite sides of peripheral edges 32 of the front section to facilitate insertion and removal of items in this compartment such as credit cards and driver's license. Retaining tabs 38 and 40 project from the top and bottom portions of the peripheral edge 32 so that inserted items can be slipped beneath these tabs for retention. Projections 42 extend upwardly from the bottom of the compartment 34 spaced inwardly from notches 33 to hold items such as credit cards in a slightly flexed and elevated position above the bottom of the compartment so that the user can conveniently grasp the inserted items. Preferably projections 42 extend to an elevation slightly above the bottom surface of tabs 38 and 40 so the retained credit card is flexed in a slightly concave configuration. This maintains the cards in the compartment against accidental loss and makes removal of a card more convenient. To remove a card, a user would insert the forefinger along the cut-out 33 beneath the edge of the contained card and grasp the card with the thumb and forefinger.

A lip or flange 44 extends from the upper edge of section 24 generally perpendicular to face plate 25. In a closed position the flange 44 extends to the rear plate 14. This flange is provided with a lug 45 which cooperates with an appropriate aperture 52 in the plate 14 for locking the receptacle in a closed position. As pointed out above, compartment 34 formed in the front section of the receptacle 10 is primarily for reception of rigid items such as credit cards and driver's licenses. These items may be conveniently placed in the compartment 34 with the items retained under the opposite tabs 40 and 42. The opposite semi-circular cut-outs 33 permit the user to insert a finger beneath the card to remove the card from the compartment.

Figure 2:
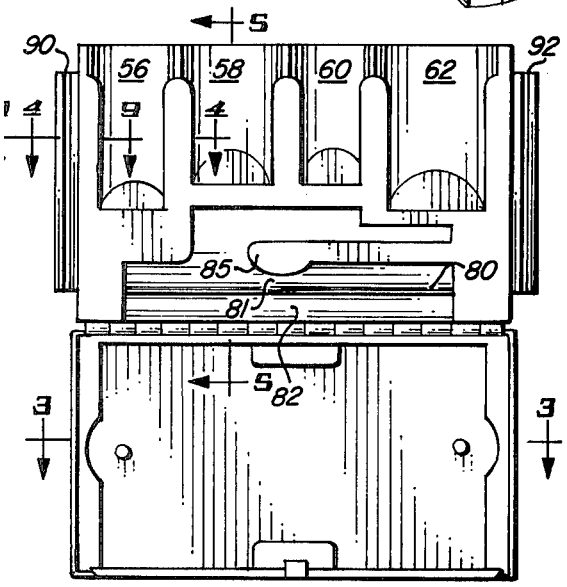
FIG. 2 is a front view of the receptacle of the present invention in an open position.

The rear section 14 of the receptacle 10 is sub-divided or compartmented to accommodate other items commonly carried by individuals. A plurality of channels 56, 58, 60 and 62 are provided for reception of coins of various denominations. For example, channel 62 is configured for reception of quarters, channel 60 for dimes, channel 58 for nickels and channel 56 for pennies. The construction of these channels is unique as the coins are held in an angular, overlapping position which makes manual insertion and removal of coins particularly convenient. This is best illustrated in FIGS. 2, 3, and 5 where it can be seen that the user can place a finger along the channel and tactually engage one or any selected number of coins in a channel and remove them by drawing them upwardly and out of the channel with visual guidance.

Figure 3:
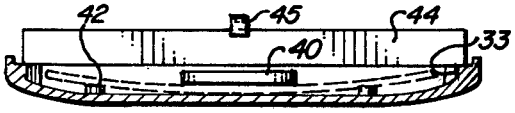
FIG. 3 is a sectional view taken along the lines 3—3 of FIG. 2.
Figure 4:
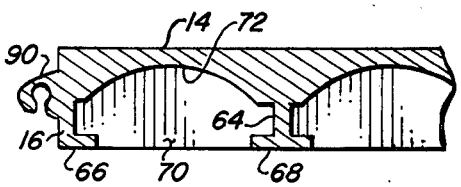
FIG. 4 is a sectional view taken along lines 4—4 of FIG. 2.

The construction of the individual channels is best seen in FIGS. 1, 3 and 5. Each of the channels 56, 58, 60, and 62 has a width selected to accommodate a particular denomination of coin. Opposite sidewalls 64 and 16 project at generally right angles to the bottom wall 14 of the rear section of the receptacle. It will be noted that the outside walls of channels 56 and 61 also commonly define one edge of the rear section 12. Flanges 66 and 68 project inwardly from the upper ends of walls 16 and 64 defining a slot 70 extending longitudinally along the respective channels. The bottom of the channel is generally concave as shown at 72. The end wall 74 of the channel is bevelled or tapered forming a generally obtuse angle with respect to plate 14 as best seen in FIG. 5. When coins are inserted in the respective channel, they are retained by flanges 66 and 68. The bottom coin in the stack when inserted will abut the end wall 74 so that all of the coins stack in overlapping, angular relationship shown in FIGS. 1 and 5. As pointed out above, the longitudinal slot 70 permits the user to manually engage and remove any number of coins as required without having to visually coordinate the procedure. As will be seen, this is particularly advantageous when the receptacle is worn as a belt buckle as it facilitates convenient removal of coins, if for example, the user is seated in an automobile.

A partition wall 80 extends transversely across rear section 14 of the receptacle intermediate the lower end of the coin receiving channels and lower wall 21 with transverse compartments 81 and 82 formed on either side of the wall. Wall 80 is preferably angled with respect to rear wall 14 generally conforming to the slope of end walls 74 of the coin channels. Wall 80 may also be slightly concave to facilitate insertion and removal of articles. A flexible tab 85 attached to the lower end of channel 62 partially overlays the compartment 81. Preferably, tab 85 has its outer end slightly turned up so that one or more keys or similar objects may be inserted in compartment 81 beneath the tab 85 and retained by the flexible tab.

The transverse compartment 82 formed between partition wall 80 and end wall 21 is adapted to receive currency, documents or other similar articles. For example, several bills can be folded and inserted in the slot-like compartment 82. When the receptacle is opened, a portion of the bills would extend out of the compartment so the money can be withdrawn as required. Currency extending from the compartment can be received in opposite compartment 34 when the receptacle is closed. Obviously, the number of credit cards and the amount of currency that can be contained within the receptacle are interdependent.

As pointed out above, the receptacle of the present invention can be used as a belt buckle or as a separate purse for reception of articles. In order that the receptacle 10 can be secured to a conventional belt or clipped on another article of apparel, mounting flanges 90 and 92 are provided on opposite edges 16 and 18 of the rear section of the receptacle. As seen in FIG. 7, each of the flanges 90 and 92 are provided with a medial slot or groove 94. Slot or groove 94 is preferably of the cross-section as shown in FIG. 9 having a relatively narrow mouth and enlarging from the opening. Clips 98 and 100 are secured to opposite ends of the belt. Each of the clips has a transversely extending locking member 97 of rectangular cross-section which is engageable in the flange slots to secure the receptacle in place as a buckle. The locking member 97 is inserted into opening 94 and rotated as seen in FIG. 7 to a "locked" position. Preferably one end of the belt is looped through the clips and is reversely secured by loop and pile fastener materials 103 secured to the rear side of the belt. Material of this type is sold under the trademark "VELCRO". A significant advantage of the clip fastener is that it is not necessary for the belt to pass through or by the receptacle so that the overall width of the assembly is reduced by the thickness of the belt for the confort of the user.

An alternate embodiment of the clips for attaching the receptacle to an article of apparel is shown in FIG. 6. Clips, as designated by the numeral 102, are generally similar to the clips 98 and 100 shown in FIG. 1 but further include an open-ended hook or tab 104 of a suitable spring material. This hook cooperates with the clip so that the hook can be slipped over an item of apparel such as a belt. In this way the receptacle does not have to be used as a belt buckle but can be carried by the user as a purse even when not wearing a belt. For example, the tab 104 could be slipped over the waistband of a skirt or pair of trousers and the receptacle maintained in proper position. Tab 104 could be joined at both ends to the body of the clip forming a continuous loop through which a belt could be passed.

FIG. 10 shows another embodiment of the present invention generally designated by the numeral 110. In this embodiment the receptacle 10A is generally as described with FIG. 1 having a rear section 12A and a front section 24A hingedly secured at 26A. Compartment 34A is adapted to receive and retain various items as has been described. Rear section 12A has rear wall 14A and opposite sides 12A and 14A. Coin channels 56A, 58A, 60A and 62A are formed in tray 112. As is seen in FIG. 10, the tray 112 is slidably received between edges 16a and 18A of the rear section of the receptacle. Should the user desire to remove the tray and insert other articles, this can be accomplished by sliding the tray out of engagement with the rear section 14A. In this way, the receptacle 10A would define one large compartment for reception of articles such as cigarettes or medications.

Tray 112 also defines a single storage compartment 115. The receptacle may also include a removable, covered container 116 for insertion into compartment 115 for reception of small articles such as medications in the form of pills or capsules.

The receptacle of the present invention can be fabricated from various materials such as plastic or metal. The receptacle can be provided with any desired surface ornamentation as seen in FIG. 2 to add to the appearance and commercial appeal of the article. Used as a belt buckle, the receptacle has little more bulk than an ordinary western-style buckle and has the same appearance as a buckle and also affords a secure place for valuable articles. The receptacle can be used without a belt and clipped to other articles of apparel and used as a purse by the user.

When the receptacle is clipped in place, the contents are easily accessible without removing the receptacle. Note that there are no barriers interfering with removal of contained articles when the receptacle is opened. The user simply disengages the clasp and swings the front section 24 forwardly. This exposes the entire contents of both sections of the receptacle. Note in this position that coins held in the coin retainers 56, 58, 60 and 62 may be easily removed or replaced manually without the necessity of the user having to visually count off the desired number and denominations of coins. Similarly, currency, credit cards and other items are readily available.

Accordingly, it will be seen that the present invention provides a novel, unique and secure compartment for convenient storage and dispersion of articles commonly carried by individuals. The item may be used as a belt buckle carrying appropriate ornamentation to add to the aesthetic and commercial appeal or may be clipped on other articles of apparel if the wearer does not desire to use it as a belt buckle.

The various items such as coins, currency, credit cards, can be placed in separate compartmented storage areas specially designed for reception and dispension of these articles. The receptacle does not have to be detached or removed when the user wishes to either place an article in the compartment or remove an article from the compartment.

It will be obvious to those skilled in the art to make certain changes, modifications and alterations to the embodiments herein chosen for purposes of illustration. To the extent that these changes, modifications and alterations do not depart from the spirit and scope of the appended claims, they are intended to be encompassed therein.

I claim:

1. A receptacle for receiving and storing in an organized, convenient manner items such as coins, currency, credit cards and the like comprising:

(a) a first storage section including a rear plate having an inner and outer surface, a top edge, a bottom edge, and opposite sidewalls;

(b) at least one coin receiving channel in said first storage section including:

(i) first and second generally parallel spaced apart flanges upstanding from said inner surface, said inner surface being generally concave between said flanges, (ii) lip means on said flanges generally parallel to said rear plate and defining an elongated opening therebetween;

(iii) a transverse end wall extending beneath and between said flanges and defining a generally obtuse angle with respect to said rear plate; and (iv) the upper end of said coin receiving channel defining an opening free of obstruction whereby coins can be stacked in said channel in angled, partially overlapping arrangement for convenient manual engagement via said elongated opening and removal through said top opening;

(c) compartment means in said first storage section located subjacent said end wall of said coin receiving channel adapted for receipt of currency or similar items;

(d) a second storage section complementary with said first storage section when the receptacle is in a closed position, said second storage section having a front wall with inner and outer surfaces, peripheral top, bottom and side edges extending around the inner surface of said front wall and defining a generally rectangular document receiving compartment, said document receiving compartment being configured and sized to accommodate credit cards and including means for securing said credit cards in a position for convenient insertion and removal; and (e) releasing locking means for holding said receptacle in the closed position with the first and second sections in complementary relationship having the size and appearance in the closed position of a belt buckle with the peripheral top edge of the second storage section overlying and closing the upper end of the coin receiving channel of the first storage section.

2. The receptacle of claim 1 including mounting means on one of said sections for attaching said receptacle to an article of apparel.

3. The receptacle of claim 2 wherein said mounting means comprise clips at opposite sides of said receptacle through which opposite ends of a belt may be looped.

4. The receptacle of claim 1 wherein said opposite peripheral side edges are notched to facilitate insertion and removal of cards therein.

5. The receptacle of claim 4 wherein tab means are associated with said peripheral top and bottom edges to retain cards therein.

6. The receptacle of claim 1 wherein said coin channel is formed in a tray means which is removable from said first section.

7. A receptacle for securing and storing in an organized, convenient manner, items such as coins, currency, credit cards and the like comprising:

(a) a first storage section including a rear plate having an inner and outer surface, a top edge, a bottom edge and opposite sidewalls;

(b) at least one coin receiving channel in said first storage section including:

(i) first and second generally parallel spaced apart flanges upstanding from said inner surface, said inner surface being generally concave between said flanges;

(ii) lip means on said flanges generally parallel to said rear plate and defining an elongated opening therebetween;

(iii) a transverse end wall extending beneath and between said flanges and defining a generally obtuse angle with respect to said rear plate; and (iv) the upper end of said coin receiving channel defining an opening free of obstruction whereby coins can be stacked in said channel in angled, partially overlapping arrangement for convenient manual engagement via said elongated opening and removal through said top opening;

(c) compartment means in said first storage section located subjacent said coin receiving channel and adapted for receipt of currency or similar items;

(d) retaining means cooperable with said compartment means for retaining items therein;

(e) a second storage section hinged to said first section, having a front wall with inner and outer surfaces, peripheral top, bottom and side edges extending around the inner surface of said front wall defining a generally rectangular document receiving compartment, said document receiving compartment having retaining means for retaining credit cards in a flexed position for convenient insertion and removal; and (f) releasable locking means for holding said receptacle in a closed position with the first and second sections in complementary relationship with the respective top, bottom and side edges enclosing the contents and having the size and appearance in the closed position of a belt buckle with the peripheral top edge of the second storage section overlying and closing the upper end of the coin receiving channel of the first storage section.

8. The receptacle of claim 7 further including mounting flanges associated with the side edges of said first section, said flanges defining a generally circular bore parallel to said edges and a medial slot for insertion and engagement of a locking member.

* * * * *